US006698776B2

(12) United States Patent
Todd

(10) Patent No.: US 6,698,776 B2
(45) Date of Patent: Mar. 2, 2004

(54) SKATEBOARD WITH SIMULATED SNOWBOARD RESPONSE

(76) Inventor: Mark H. Todd, 1752 N. Country Cir., Centerville, UT (US) 84014

( * ) Notice: Subject to any disclaimer, the term of this patent is extended or adjusted under 35 U.S.C. 154(b) by 0 days.

(21) Appl. No.: 09/840,392

(22) Filed: Apr. 23, 2001

(65) Prior Publication Data

US 2002/0153686 A1 Oct. 24, 2002

(51) Int. Cl.[7] ..... A63C 17/00

(52) U.S. Cl. ..... 280/87.042; 280/11.19; 280/11.25; 280/11.222; 280/11.233; 280/11.227; 280/842; 301/5.301

(58) Field of Search ..... 280/87.01, 87.02, 280/87.041, 87.042, 11.19, 11.233, 11.25, 11.27, 11.28, 11.222, 11.227, 11.231, 842, 809, 11.206, 11.204; 301/5.3, 5.7, 5.301, 5.308, 5.305; D21/763, 765, 760, 771; 482/146, 71; 434/247, 253

(56) References Cited

U.S. PATENT DOCUMENTS

| | | | | |
|---|---|---|---|---|
| 1,327,123 | A | | 1/1920 | Thomas |
| 3,362,722 | A | * | 1/1968 | Core |
| 3,399,904 | A | | 9/1968 | Schinke |
| 3,795,409 | A | * | 3/1974 | Cudmore |
| 4,062,557 | A | | 12/1977 | Roden |
| 4,129,315 | A | | 12/1978 | McCallum |
| 4,337,961 | A | | 7/1982 | Covert et al. |
| 4,744,576 | A | | 5/1988 | Scollan, Jr. |
| 5,152,691 | A | * | 10/1992 | Moscarello |
| 5,195,781 | A | * | 3/1993 | Osawa ..... 280/842 |
| 5,492,352 | A | | 2/1996 | St. Clair |
| 5,553,874 | A | | 9/1996 | Schouten et al. |
| 5,601,299 | A | * | 2/1997 | Yun et al. |
| 5,803,473 | A | * | 9/1998 | Bouden ..... 280/11.19 |
| 5,810,376 | A | | 9/1998 | Matheny |
| 5,855,385 | A | | 1/1999 | Hambsch |
| 5,992,865 | A | | 11/1999 | Vargas |
| 6,209,894 | B1 | * | 4/2001 | Walker, IV ..... 280/11.222 |

FOREIGN PATENT DOCUMENTS

| | | | |
|---|---|---|---|
| GB | 2344538 | * | 6/2000 |

* cited by examiner

*Primary Examiner*—Douglas C. Butler
(74) *Attorney, Agent, or Firm*—Thorpe North & Western, LLP

(57) ABSTRACT

A skateboard for use on a hard surface, configured to simulate the response of a snowboard, has a support platform to which sets of wheels are mounted. The wheels have successively decreasing diameters mounted on a common axle. The wheels of successively decreasing diameter may additionally or alternately be formed of materials of successively greater frictional and compressibility characteristics.

14 Claims, 4 Drawing Sheets

SKATEBOARD WITH SIMULATED SNOWBOARD RESPONSE

BACKGROUND OF THE INVENTION

1. Field of the Invention

The present invention relates generally to a skateboard-like device configured to more closely simulate a snowboard, with wheels configured so that a user riding the skateboard on a hard surface experiences the sensation of riding a snowboard.

2. Related Art

Skateboards have been popular for some years for use in both recreation and physical training. Snowboards also have become very popular for similar purposes in mountainous areas with sufficient levels of snow. It has been recognized that producing a skateboard for use on hard surfaces that mimics the response of a snowboard would allow users to practice snowboarding techniques in locations without snow. Such a device would be desirable in locations that do not receive any snow, and locations that receive snow during only a few months of the year.

It will be appreciated that skateboards and snowboards are operated in different manners. Traditional skateboards utilize wheels mounted on the underside of a board in a variety of configurations, typically with pairs of wheels located near the front and rear of the skateboard. A rider manipulates a traditional skateboard by leaning toward the direction in which he wishes to turn and applying a lateral force to the board to produce incremental lateral sliding movements of the wheels, which results in the skateboard changing direction.

A rider manipulates a snowboard using two primary methods. First, the rider can manipulate the snowboard by leaning toward the direction in which he wishes to turn, thereby causing the inside edge of the snowboard to dig into the snow and force the snowboard into a turn. Alternately, the rider can manipulate a snowboard by utilizing the slick under-surface of the board and simply sliding the snowboard into a new direction while the majority of the underside of the board maintains contact with the snow. A rider can also manipulate a snowboard by using a combination of these two techniques.

U.S. Pat. No. 5,553,874 to Schouten et al. discloses a truck assembly for a roller board apparatus. The invention utilizes two separate axles on both the front and the rear of a platform. The axles are curved outwardly with a plurality of wheels of equal diameter separated by spacer elements.

SUMMARY OF THE INVENTION

It has been recognized that it would be advantageous to develop a skateboard for use on hard surfaces that mimics or simulates the response of a snowboard and allows users to practice snowboarding techniques in locations without snow.

The present invention provides an enhanced skateboard device with a platform mounted on wheels. In accordance with one aspect of the present invention, the wheels advantageously include wheels of varying diameter mounted on a common axle. Preferably, the wheels include one or more larger diameter wheels in the center, medium diameter wheels outside the larger wheels, and smaller diameter wheels outside the medium wheels so that the wheels have successively smaller diameters from a center of the platform or axel to the edges of the platform or ends of the axel. A rider can manipulate the enhanced skateboard by leaning toward the direction in which he wishes to turn, thereby engaging the progressively smaller diameter wheels on the common axle and producing a sensation similar to that experienced by a snowboarder when the inside edge of the snowboard digs into the snow during a turn.

In accordance with another aspect of the present invention, the wheels can include wheels with different frictional and/or compressibility characteristics. Preferably, the wheels include one or more harder wheels in the center, medium wheels on opposite sides of the harder wheel, and softer wheels on opposite sides of the medium wheels so that the wheels have a successively greater frictional and/or compressibility characteristic. Thus, the rider can manipulate the enhanced skateboard by sliding the enhanced skateboard while riding on the largest diameter wheels on the common axle, which have very low frictional characteristics, thereby imitating the response of a snowboard sliding into a new direction. The enhanced skateboard rider can also affect a turn by using a combination of these two techniques. In accordance with a more detailed aspect of the present invention, the device includes at least two sets of wheels of varying diameters mounted on their respective common axles. The wheels are configured so that the center wheels on a common axle have the largest diameter and the wheels on either side of the center wheels are of smaller diameter. The wheels on either side of these wheels are of even smaller diameter. This pattern may be repeated for any number of outer wheels as is desirable.

In accordance with another more detailed aspect of the present invention, the device may alternately or additionally include wheels mounted on a common axle made from materials with varying frictional and compressibility characteristics. The wheels are configured so that the center wheels on a common axle are made of a material having low frictional characteristics and low compressibility. The wheels on either side of the center wheels are made of a material with greater frictional characteristics and compressibility. The wheels on either side of these wheels are made of a material of even greater frictional characteristics and compressibility.

In accordance with another more detailed aspect of the present invention, the device may include one or more wheels mounted on a common axle having tapering diameters that decrease from the center of the board to the sides of the board.

In accordance with another more detailed aspect of the present invention, the device may include an additional set of one or more secondary wheels on a common axle mounted near either or both ends of the platform. These secondary wheels are of smaller diameter and allow the rider to lean the platform back onto the secondary wheels so that the front or rear set of wheels of varying diameter are not in contact with the ground.

Additional features and advantages of the invention will be apparent from the detailed description which follows, taken in conjunction with the accompanying drawings, which together illustrate, by way of example, features of the invention.

DETAILED DESCRIPTION

Figure 1:
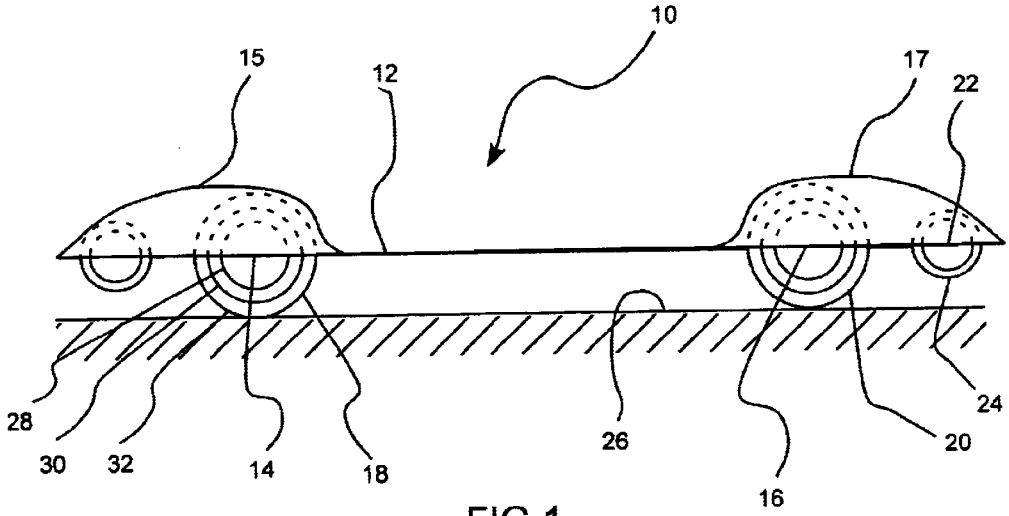
FIG. 1 is a side elevational view of an embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring now to FIGS. 1 through 8, wherein like reference numerals refer to like parts throughout, the skateboard device as shown in FIGS. 1 through 3*b*, denoted generally by 10, includes a platform 12 having a front and rear axles, 14 and 16 respectively, mounted transversely across the platform 12. Front and rear sets of wheels 18 and 20 are mounted on the front and rear axles 14 and 16, respectively. It is of course understood that either end of the skateboard device 10 may be designated as the front or rear. Secondary axles 22 are positioned forwardly and rearwardly of the forward and rear axles 16 and 18, and also are mounted transversely across the platform 12. Secondary sets of smaller diameter wheels 24 are mounted on the secondary axles 22. The skateboard 10 is designed to be operated on hard surfaces 26, such as concrete or asphalt.

The axles 14 and 16 can be coplanar with the platform 12 to allow the platform 12 to be closer to the ground. By moving the platform 12 closer to the ground, the skateboard 10 can more accurately imitate the response or feel of a snowboard, which is in direct contact with the snow covered ground on which a snowboard is operated. Openings can be formed in the platform 12 to accommodate the sets of wheels 18 and 20 which can protrude through the openings. Covers 15 and 17 can be placed over the openings in the platform 12 to prevent interference and/or injury between the sets of wheels 18 and 20 and the feet of the rider. The covers 15 and 17 also allow for the rider to step thereon in order to raise the opposite end in order to perform a "wheeley" maneuver.

Figure 2:
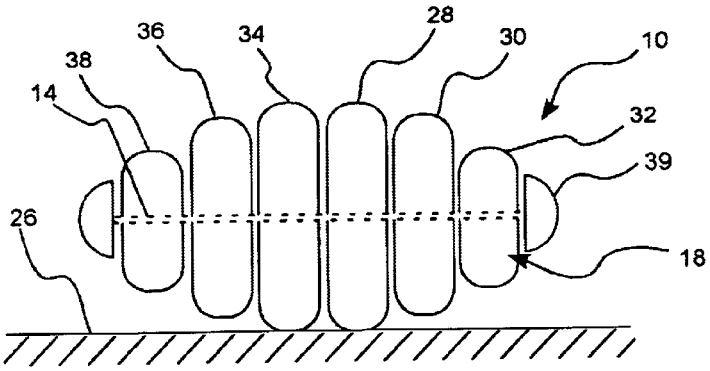
FIG. 2 is a front elevational view of the wheels of an embodiment of the present invention, shown with the larger diameter center wheels contacting the ground, as when the board is traveling in a substantially straight path.
Figure 3A:
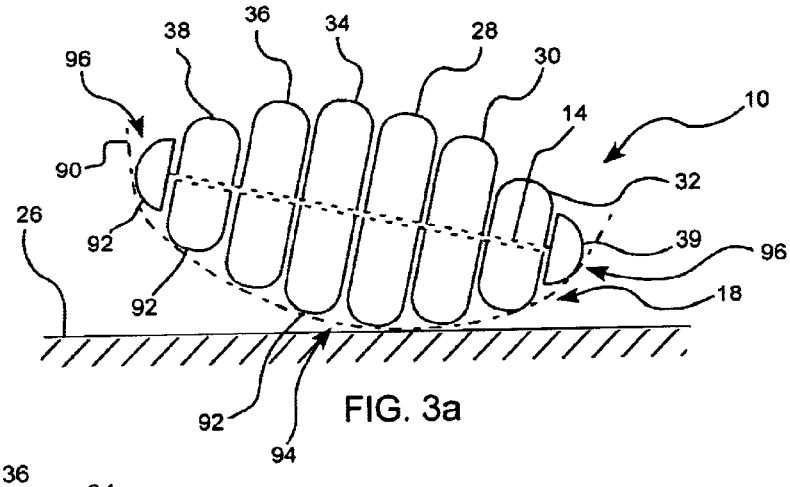
FIGS. 3*a* and 3*b* are front elevational views of the wheels of an embodiment of the present invention, shown with the smaller diameter outer wheels contacting the ground, as when the board is being turned.
Figure 3B:
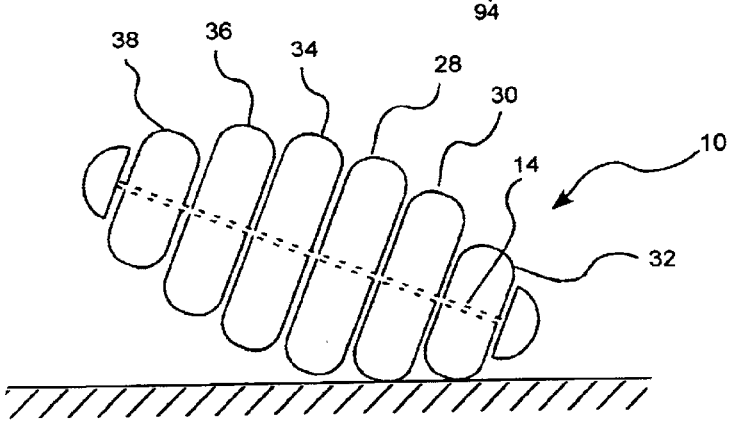

Referring more particularly to FIGS. 2, 3*a* and 3*b*, a preferred embodiment of the present invention is shown with the front set of wheels 18 mounted on the front axle 14. It is of course understood that the rear set of wheels 18 can have a similar configuration to that of the front set of wheels 18 shown in FIGS. 2, 3*a* and 3*b*. The set of wheels 18 preferably includes a plurality of wheels aligned or arrayed along the axle 14 with successively reduced diameters from a center of the axle 14 or platform 12, to the edges of the platform 12 or ends of the axle 14. Thus, innermost wheels can be larger than the outermost wheels. Specifically, the set of wheels 18 can include larger wheels 28 and 34 located generally in the center of the platform 12 or axle 14, medium wheels 30 and 36 located on opposite sides of the larger wheels 28 and 34, and smaller wheels 32 and 38 located on opposite sides of the medium wheels. The medium wheels 30 and 36 have diameters less than diameters of the larger wheels 28 and 34, while the smaller wheels have diameters less than the diameters of the medium wheels 30 and 36. The set of wheels 18 is symmetrical about a center of the axle 14 or platform 12 such that the diameter and composition of the larger wheels 28 and 34 are equal to each other, the diameter and composition of the medium wheels 30 and 36 are equal to each other, and the diameter and composition of the smaller wheels 32 and 38 are equal to each other. It is of course understood that the larger wheels 28 and 34 can be a single, larger wheel. In addition, wheels or knobs 39 can be formed on the ends of the axle 14 to form the outermost wheels of the set of wheels. The wheels or knobs 39 can have a semi-spherical shape.

By including the larger wheels 28 and 34 in the center of axle 14 or platform 12, the skateboard 10 of the present invention can be operated much like a traditional skateboard when the rider is travelling in a substantially straight direction. However, when the rider turns the skateboard 10, the unique aspect of the configuration of the wheels of the present invention allow the rider to more accurately experience the sensation of operating a snowboard. The set of wheels 18 of successively smaller diameter mounted on a common axle allows the skateboard 10 of the present invention to more accurately imitate the response of a snowboard. FIG. 2 represents the level horizontal cant of the axle 14 as the skateboard travels in a substantially straight direction. As is shown in FIG. 3*a*, as the rider leans into a turn, the platform 12 and axle 14 tilt, and the medium wheel 30 makes contact with the surface or ground 26. One of the larger wheels 28 may continue to contact the surface or ground 26 along with the medium wheel 30, while the other larger wheel 34 may not. As shown in FIG. 3*b*, as the rider continues to lean into a turn, the medium wheel 30 and smaller wheel 32 make contact with the surface or ground 26, while both the larger wheels 28 and 34 may not. Alternatively, multiple wheels 28, 30 and 32 on one side of the platform 12 can contact the ground 26 as the rider tilts the platform. Therefore, the successively smaller wheels arrayed along the common axis allow the platform 12 to tilt with respect to the ground 26, and thus simulate the orientation of a snowboard.

It is believed that wheels with successively smaller diameters offer successively greater rolling resistance and/or a different rolling response as a rider leans the skateboard 10 into a turn. For example, the speed with which the skateboard 10 is travelling decreases as the rider leans into a turn, and the skateboard 10 thus allows the rider to more fully experience the sensation of a snowboard digging into the snow as the rider leans into a turn.

In addition, the set of wheels 18 can include a plurality of wheels with different frictional characteristics to further enhance the ability of the present invention to simulate the drag experience of riding a snowboard. The set of wheels 18 can be formed of a material of successively higher frictional characteristics from the center of the platform 12 or axel 14 to the edges of the platform 12 or ends of the axel 14. Thus, the outermost wheels can have higher frictional characteristics while the innermost wheels can have lower frictional characteristics. Specifically, the innermost wheels 28 and 34 can have low frictional characteristics, the intermediate wheels 30 and 36 can have greater frictional characteristics, and the outermost wheels 32 and 38 can have even greater frictional characteristics. As stated above, the frictional characteristics of the wheels can be determined by the material of the wheels. Alternatively, the frictional characteristics may be determined by the wheel's bearings. As the rider leans into a turn, as shown in FIGS. 3*a* and 3*b*, the wheels with successively higher frictional characteristics, such as the intermediate and outer wheels 30 and 32, make contact with the surface or ground 26, while the innermost wheels 28 and 34 may or may not make contact with the surface 26.

It is believed that wheels of successively greater frictional characteristics offer greater drag or rolling resistance and/or different rolling response. For example, the speed with which the skateboard 10 is travelling decreases due to the greater frictional characteristics of the intermediate and/or outer wheels as the rider leans into a turn, thus allowing the rider to experience the sensation of a snowboard digging into the snow as the rider leans into a turn. Additionally, because the innermost wheels 28 and 34 have very low frictional characteristics, they offer very little resistance to lateral movement. Therefore, the rider may spin the skateboard into a new position while the wheels 28 and 34 maintain contact with the hard surface 26, thus further simulating the response of a snowboard.

Figure 4:
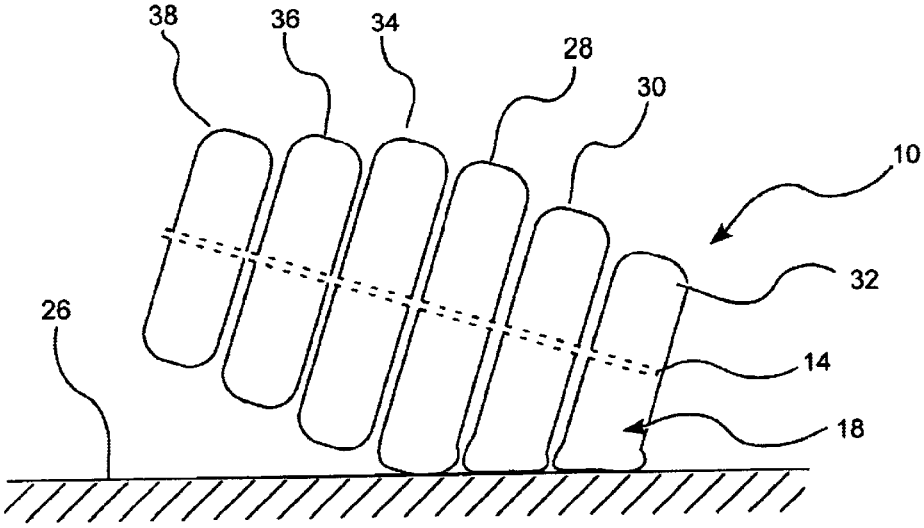
FIG. 4 is a front elevational view of the wheels of an embodiment of the present invention, shown with the smaller diameter outer wheels contacting the ground and compressing accordingly, as when the board is being turned.

Furthermore, the set of wheels 18 can include a plurality of wheels with different compressibility to further enhance the ability of the skateboard 10 of the present invention to simulate the experience of riding a snowboard. As shown in FIGS. 2 and 4, the set of wheels 18 can include wheels which are formed of a material of a successively higher compressibility from the center of the platform 12 or axel 14 to the edges of the platform 14 or ends of the axel 14. Thus, the innermost wheels 28 and 34 can be more rigid or stiff, while the outermost wheels 32 and 38 can be more compressible or flexible. Specifically, the innermost wheels 28 and 34 can have lower compressibility or greater rigidity, the intermediate wheels 30 and 36 can have greater compressibility than the innermost wheels, and the outermost wheels 32 and 38 can have even greater compressibility than the intermediate wheels. As stated above, the compressibility of the wheels can be determined by the material of the wheels. As the rider leans into a turn, the wheels with successively higher compressibility, such as intermediate and outer wheels 30 and 32, make contact with the surface of ground 26 and may compress. As the wheels 30 and 32 compress, they spread or expand laterally outward and contact a greater surface area of the ground, as shown in FIG. 4.

It is believed that wheels of successively higher compressibility will offer successively greater rolling resistance. Consequently, the speed with which the skateboard 10 is travelling decreases as the rider leans into a turn, and the rider thus experiences the sensation of a snowboard digging into the snow as the rider leans into a turn.

Figure 5:
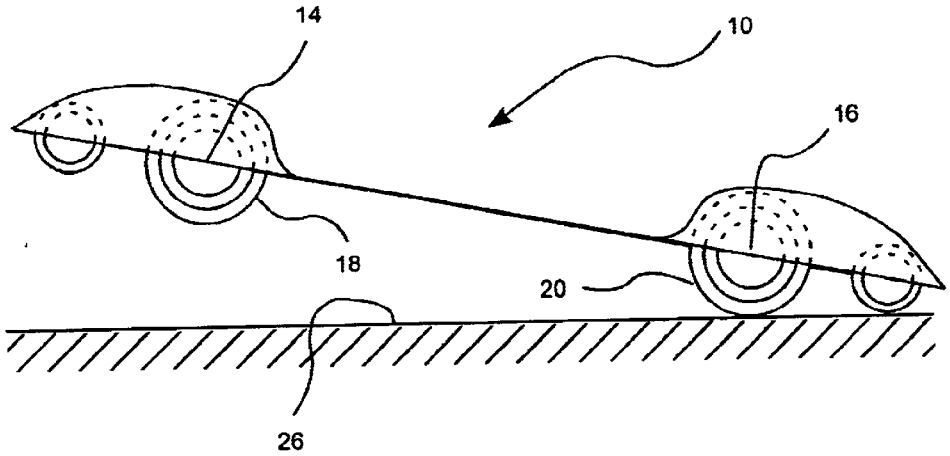
FIG. 5 is a side elevational view of an embodiment of the present invention, shown with the front-most wheels elevated and the smaller rear wheels contacting the ground.

The use of the secondary axles 22 and secondary sets of wheels 24 is shown in FIG. 5. The rider can use the secondary axle 22 and secondary sets of wheels 24 to perform "wheely" maneuvers, in which the front or rear sets of wheels 18 and 20 are completely removed from contact with the hard surface 26 while the opposite set of wheels remains in contact with the hard surface 26. The rider can tilt the platform 12 forwardly or rearward about the axle 14 or 16 until contact is made with the secondary set of wheels 24, thereby increasing the rider's ability to control the skateboard 10 while performing "wheely" maneuvers.

In addition, the secondary sets of wheels 24 can include wheels of different diameters, and/or wheels of different frictional or compressibility characteristics. Thus, the rider can pivot the platform 12 rearwardly to perform a "wheely" maneuver, and at the same time pivot the platform 12 laterally onto smaller diameter wheels on both the rear axle 16 and the secondary axle 22.

Figure 6:
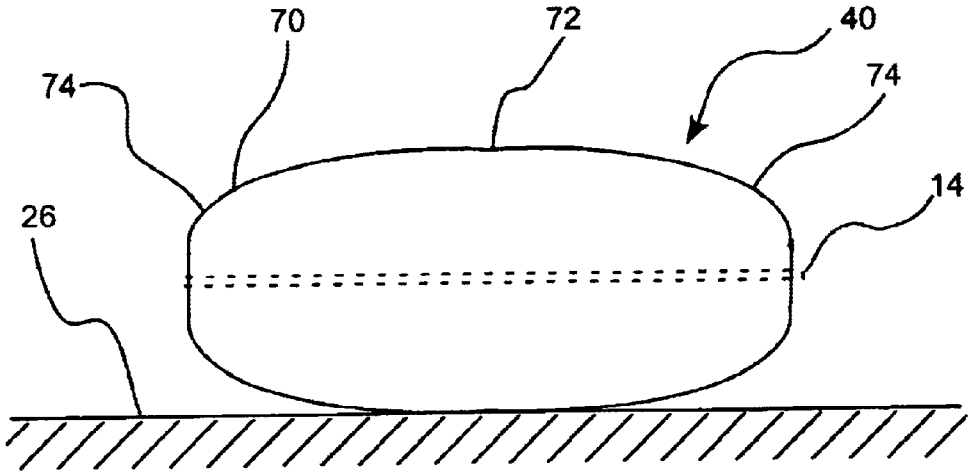
FIG. 6 is a front elevational view of the wheels of an alternate embodiment of the present invention.

Referring to FIG. 6, an alternative configuration of a wheel 40 is shown with a tapering diameter that can be used to further enhance the ability of the present invention to simulate the response of a snowboard. The wheel 40 is shaped to have a symmetrically decreasing diameter that reduces from its largest diameter in the center of the wheel 40 outward along the axle 14. Thus, the wheel 40 has a continuous surface area with a substantially decreasing diameter along its width from the center to the ends. By using such a wheel 40, the present invention allows the rider a smooth transition from travelling in a substantially straight direction, when the center of the wheel with the largest diameter of wheel 40 contacts the hard surface 26, to leaning into a turn, when the end of the wheel with the smallest diameter contacts the hard surface 26. As the wheel 40 rolls on a successively smaller diameter, it is believed that the rolling resistance of wheel 40 will increase, causing a decrease in the speed with which the skateboard 10 is travelling. This smooth transition from a faster to a slower speed as the rider leans into a turn further simulates the response of a snowboard as the snowboard digs into the snow during a turn.

Figure 7:
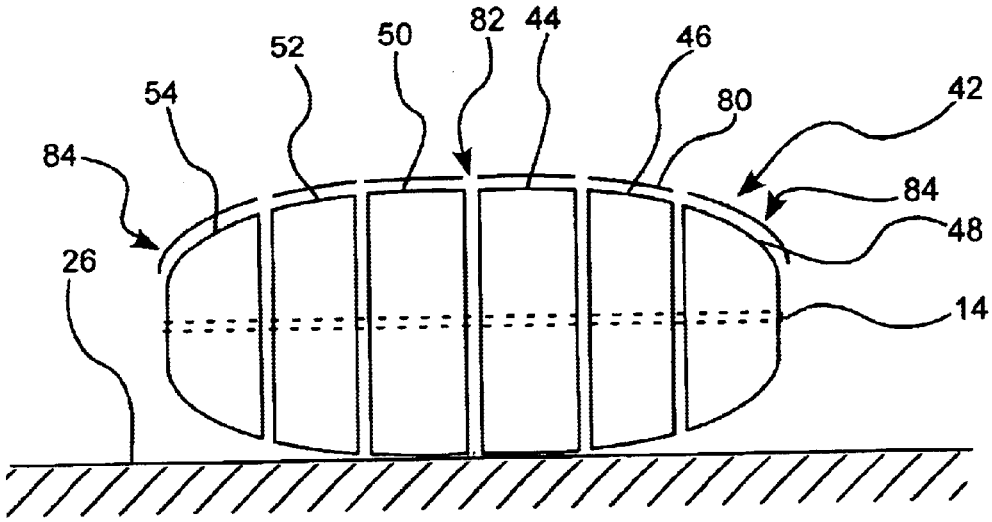
FIG. 7 is a front elevational view of the wheels of an alternate embodiment of the present invention.

Furthermore, a similar result may be achieved by using multiple wheels forming a tapered diameter. FIG. 7 shows an alternate embodiment of the present invention wherein the set of wheels 42 on the axle 14 are shaped such that their diameters continuously reduce from the center of the set of wheels 42 outward along the axle 14. The largest diameter of wheel 48 is smaller than the smallest diameter of wheel 46, and the largest diameter of wheel 46 is smaller than the smallest diameter of wheel 44. The set of wheels 42 is symmetrical about the center of the axle 14 such that the shape and composition of wheel 50 are equal to that of wheel 44, the diameter and composition of wheel 52 are equal to that of wheel 46, and the diameter and composition of wheel 54 are equal to that of wheel 48.

The collective shape of the set of wheels 42 allows the rider a smooth transition from travelling in a substantially straight direction, when wheels 44 and 50 are in contact with the hard surface 26, to leaning into a turn, when wheels 44, 46 and 48 may all be in contact with the hard surface 26. As more wheels contact the hard surface 26, the collective rolling resistance of the set of wheels 42 increases, causing a decrease in the speed with which the skateboard 10 is travelling. This smooth transition from a faster to a slower speed as the rider leans into a turn simulates the response of a snowboard as the snowboard digs into the snow during a turn.

Figure 8:
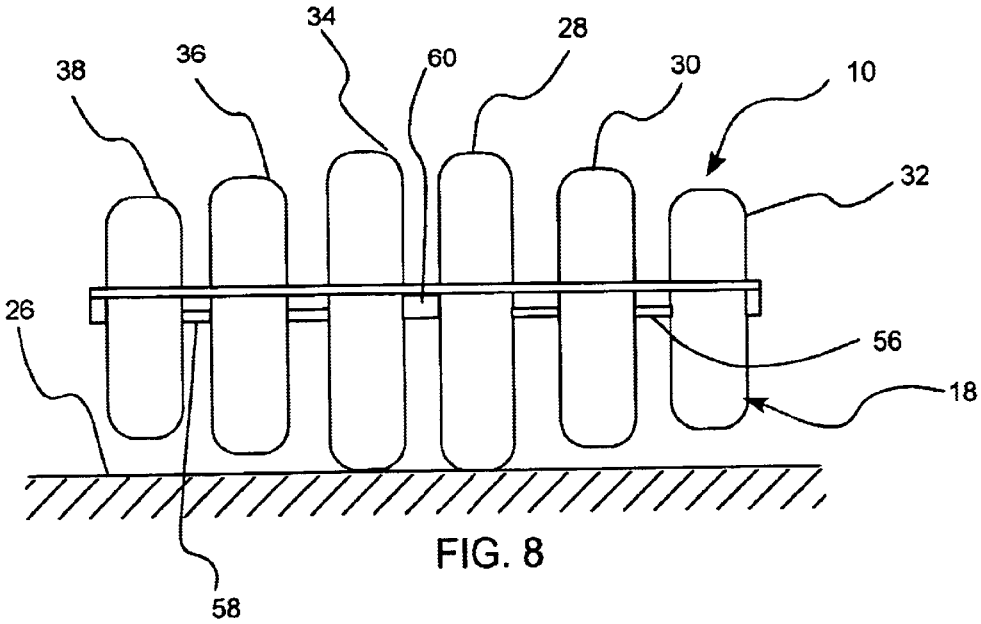
FIG. 8 is a front elevational view of the wheels of an alternate embodiment of the present invention.

It is of course understood that the basic configuration of the wheels and axels of the present invention can be modified. For example, a vertical support 60 can be provided between the wheels as shown in FIG. 8. In addition, it is understood that the axle 14 of previous configurations can be replaced with two axles, 56 and 58. The axles 56 and 58 are supported on both ends, with the center vertical support 60 constraining both axles 56 and 58 in the center of the platform 12. Alternately, axle 14 could be used as in previous configurations, with center vertical support 60 constraining axle 14 at its center. A more stable mounting system can thus be used with any of the preceding systems of wheels. In addition, it is understood that the wheels can have different sizes, such as diameters and widths, and that different numbers of wheels can be used.

As illustrated in FIG. 6, in accordance with another feature of the present invention, a diameter of the at least one wheel 40 is selected to form a continuous, curved line 72 which extends along a contact surface of the wheel 40 from a central 72 portion of the wheel to a distal 74 portion of the wheel. This curved contact surface provides a gradual, and continually varying contact interface between the skateboard and the riding surface 26 to more effectively provide a snowboard response by the skateboard.

In the embodiment illustrated in FIG. 7, the at least one wheel includes a set of wheels 42 and a diameter of each wheel of the set of wheels is selected to form a segmented, curved line 80 extending across contact surfaces of the wheels from a central 82 to a distal 84 portion of the axle. Selecting the diameters of the wheels accordingly provides a continuous, curved contact interface between the wheels and the riding surface 26 to allow a user to gradually turn or tilt the skateboard to more effectively simulate the response of a snowboard.

As shown in FIG. 3*a,* the wheels of the set of wheels 18 can include wheels having different diameters. The diameter of each wheel can be selected to position a contact surface 92 of each wheel along a segmented, curved line 90 extending across contact surfaces 92 of the wheels from a central 94 to a distal 96 portion of the common axle. Positioning the contact surfaces 92 in such a fashion provides a continually curved contact interface between the wheels and the riding surface 26. This curved contact interface provides a rider gradual transition from one incline of the board to another, which allows the rider to experience a snowboard-like response from the skateboard.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A skateboard device configured to transport a rider, the device comprising:

a) a support platform;

b) at least one axle coupled to the platform, said axle defining a common axle; and c) at least one set of wheels disposed on the common axle, including wheels having different diameters, each wheel diameter being selected to position a contact surface of each wheel along a segmented, curved line extending across contact surfaces of the wheels from a central to a distal portion of the common axle;

d) wherein the set of wheels includes:

i) at least one large wheel having a larger diameter;

ii) at least two medium wheels, each disposed on an opposite side of the at least one larger wheel, each having a medium diameter less than the larger diameter;

iii) at least two small wheels, each disposed on a side of the medium wheels opposite the larger wheel, each having a diameter less than the medium diameter; and e) wherein the set of wheels includes wheels with different frictional characteristics disposed on the common axle.

2. A device in accordance with claim 1, further comprising:

a) a second axle coupled to the platform; and b) at least one set of wheels, including wheels having different diameters disposed on the second axle.

3. A device in accordance with claim 1, further comprising:

a) an additional axle mounted near a rear of the platform;

b) at least one additional wheel rotatably disposed on the additional axle; and c) the at least one additional wheel having a diameter smaller than a diameter of one of the wheels of the set of wheels.

4. A skateboard device configured to transport a rider, the device comprising:

a) a support platform;

b) at least one axle coupled to the platform, said axle defining a common axle; and c) at least one set of wheels disposed on the common axle, including wheels having different frictional and compressible characteristics;

d) wherein the set of wheels includes:

i) at least one larger wheel having a larger diameter;

ii) at least two medium wheels, each disposed on an opposite side of the at least one larger wheel, each having a medium diameter less than the larger diameter; and iii) at least two smaller wheels, each disposed on a side of the medium wheels opposite the larger wheel, each having a diameter less than the medium diameter.

5. A device in accordance with claim 4, further comprising:

a) a second axle coupled to the platform; and b) at least one set of wheels, including wheels having different diameters disposed on the common axle.

6. A device in accordance with claim 4, wherein the set of wheels includes wheels having different diameters disposed on the common axle.

7. A device in accordance with claim 4, further comprising:

a) an additional axle mounted near a rear of the platform;

b) at least one additional wheel rotatably disposed on the additional axle; and c) the at least one additional wheel having a diameter smaller than a diameter of one of the wheels of the set of wheels.

8. A skateboard device configured to transport a rider, the device comprising:

a) a support platform;

b) at least one axle coupled to the platform;

c) at least one wheel rotatably mounted on the axle;

d) a diameter of the at least one wheel being selected to form a continuous, curved line extending along a contact surface of the wheel from a central to a distal portion of the axle; and e) the at least one wheel including;

i) at least one harder wheel formed of a harder material;

ii) at least two medium wheels, each disposed on an opposite side of the harder wheel, formed of a medium material softer than the harder material; and iii) at least two softer wheels, each disposed on a side of the medium wheels opposite the harder wheel, formed of a soft material softer than the medium material.

9. A device in accordance with claim 8, further comprising:

a) a second axle coupled to the platform; and b) at least one set of wheels, including wheels having different diameters disposed on the common axle.

10. A device in accordance with claim 8, further comprising:

a) an additional axle mounted near a rear of the platform;

b) at least one additional wheel rotatably disposed on the additional axle; and c) the at least one additional wheel having a diameter smaller than the diameter of the at least one wheel.

11. A device in accordance with claim 8, wherein the wheel includes a set of wheels, including:

a) at least one larger wheel having a larger diameter;

b) at least two medium wheels, each disposed on an opposite side of the at least one larger wheel, having a medium diameter less than the larger diameter; and c) at least two smaller wheels, each disposed on a side of the medium wheels opposite the large wheel, each having a diameter less than the medium diameter.

12. A device in accordance with claim 8, wherein the at least one wheel includes a set of wheels, a diameter of each wheel of the set of wheels being selected to form a segmented, curved line extending across contact surfaces of the wheels from a central to a distal portion of the axle.

13. A skateboard device configured to transport a rider, the device comprising:

a) a support platform;

b) at least one axle coupled to the platform, said axle defining a common axle; and c) at least one set of wheels disposed on the common axle, including wheels having different diameters, each wheel diameter being selected to position a contact surface of each wheel along a segmented, curved line extending across contact surfaces of the wheels from a central to a distal portion of the common axle;

d) wherein the set of wheels includes wheels with different frictional characteristics disposed on the common axle; and e) wherein the set of wheels includes:

i) at least one harder wheel formed of a harder material;

ii) at least two medium wheels, each disposed on an opposite side of the harder wheel, formed of a medium material softer than the harder material; and iii) at least two softer wheels, each disposed on a side of the medium wheels opposite the harder wheel, formed of a soft material softer than the medium material.

14. A skateboard device configured to transport a rider, the device comprising:

a) a support platform;

b) at least one axle coupled to the platform, said axle defining a common axle; and c) at least one set of wheels disposed on the common axle, including wheels having different frictional and compressible characteristics;

d) wherein the set of wheels includes:

i) at least one harder wheel formed of a harder material;

ii) at least two medium wheels, each disposed on an opposite side of the harder wheel, formed of a medium material softer than the harder material; and iii) at least two softer wheels, each disposed on a side of the medium wheels opposite the harder wheel, formed of a soft material softer than the medium material.

* * * * *